US006832734B2

(12) United States Patent
Rafferty et al.

(10) Patent No.: US 6,832,734 B2
(45) Date of Patent: Dec. 21, 2004

(54) MEDIA DISCHARGE DEVICE

(75) Inventors: William J. Rafferty, San Antonio, TX (US); William C. Flannigan, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 237 days.

(21) Appl. No.: 09/961,066

(22) Filed: Sep. 24, 2001

(65) Prior Publication Data

US 2002/0158147 A1 Oct. 31, 2002

Related U.S. Application Data

(60) Provisional application No. 60/285,993, filed on Apr. 25, 2001.

(51) Int. Cl.[7] ..... A62C 31/24

(52) U.S. Cl. ..... 239/280; 239/281; 239/285; 239/222

(58) Field of Search ..... 239/77, 127, 142, 239/168, 172, 216, 285, 222, 280, 281; 904/84.8, 101, 109

(56) References Cited

U.S. PATENT DOCUMENTS 525,487 A 9/1894 Crawford
2,111,553 A 3/1938 Chew
2,919,071 A 12/1959 Dalton
3,149,438 A 9/1964 Morley et al.
3,402,583 A 9/1968 Burney
3,655,130 A * 4/1972 Patrick ..... 239/77
3,744,719 A * 7/1973 Wallick ..... 239/722
3,809,318 A 5/1974 Yamamoto
4,232,632 A * 11/1980 Kice ..... 119/844
4,641,644 A * 2/1987 Andersson et al. .... 128/200.23
4,875,526 A * 10/1989 Latino et al. ..... 169/24
5,249,632 A 10/1993 Sparling et al.
5,788,715 A * 8/1998 Watson, Jr. et al. ..... 606/140
5,791,565 A 8/1998 Olsson
6,315,648 B1 * 11/2001 Neer ..... 451/92
6,588,976 B2 * 7/2003 Quenzi et al. ..... 404/84.8

* cited by examiner

*Primary Examiner*—Gene Mancene
*Assistant Examiner*—Thach H. Bui
(74) *Attorney, Agent, or Firm*—Oliff & Berridge, PLC

(57) ABSTRACT

A media discharge device includes a support member, a telescoping device supported by the support member, and a media discharge port provided at a first end of the telescoping device. The telescoping device is supported via a joint structure that allows the telescoping device to rotate with respect to the support member with at least one degree of freedom. The telescoping device includes a first member and a second member that moves with respect to the first member in an extending direction and a retracting direction. An actuator may drive the second member in the extending direction and in the retracting direction.

21 Claims, 7 Drawing Sheets

MEDIA DISCHARGE DEVICE

This application claims benefit of 60/285,993 filed Apr. 25, 2001.

The U.S. Government has a paid-up license in this invention and the right in limited circumstances to require the patent owner to license others on reasonable terms as provided for by the terms of Contract No. F42620-96-D-0042 awarded by the Department of the Air Force.

BACKGROUND OF THE INVENTION

1. Field of Invention

This invention relates to discharging media.

2. Description of Related Art

Various devices have been devised for discharging dry media, such as sand blasting media used to remove paint or rust from surfaces. Various devices have also been devised for discharging wet media, such as water, paint or the like. Such discharge devices typically discharge wet media or particles of dry media from a nozzle at high velocity.

These devices can cause operator fatigue due to their weight and due to the reaction forces caused by the high-velocity discharge. In an effort to alleviate these and other problems, various automation attempts have been made, employing robotics systems.

SUMMARY OF THE INVENTION

Robotics systems are complicated and expensive. Furthermore, they remove the operator from direct control of the process, which can result in various drawbacks. For example, in dry media blasting to remove paint from a painted surface, it is often necessary to concentrate the dry media blast more heavily on some portions of the surface than on other portions of the surface due to variations in thickness, adhesion, durability or the like of the paint. A human operator can easily see where the blast needs to be concentrated (e.g., by seeing where paint still remains after an initial blast), and manually adjust the discharge device to properly direct the blast (e.g, by aiming the discharge device a second time at the portions where paint still remains). A robotics system, on the other hand, cannot so easily detect where the blast needs to be concentrated.

Accordingly, it is an object of the invention to provide an ergonomic media discharge device that alleviates operator fatigue, but does not remove the operator from direct control of the process.

A media discharge device according to the invention includes a support member, a telescoping device supported by the support member, and a media discharge port provided at a first end of the telescoping device. The telescoping device is supported via a joint structure that allows the telescoping device to rotate with respect to the support member with at least one degree of freedom. The telescoping device includes a first member and a second member that moves with respect to the first member in an extending direction and a retracting direction. An actuator may drive the second member in the extending direction and in the retracting direction.

These and other objects, advantages and salient features of the invention are described in or apparent from the following detailed description of exemplary embodiments.

BRIEF DESCRIPTION OF THE DRAWINGS

Exemplary embodiments of the invention are described in detail with reference to the following figures, wherein like numbers reference like elements, and wherein.

DETAILED DESCRIPTION OF PREFERRED EMBODIMENTS

This invention provides ergonomic media discharge devices that alleviate operator fatigue while not removing the operator from direct control of the process. This may be done by, for example, transferring most or all of the weight of the discharge device, along with reactive forces from the discharge, to a stationary or semi-stationary object rather than to the operator.

Figure 1:
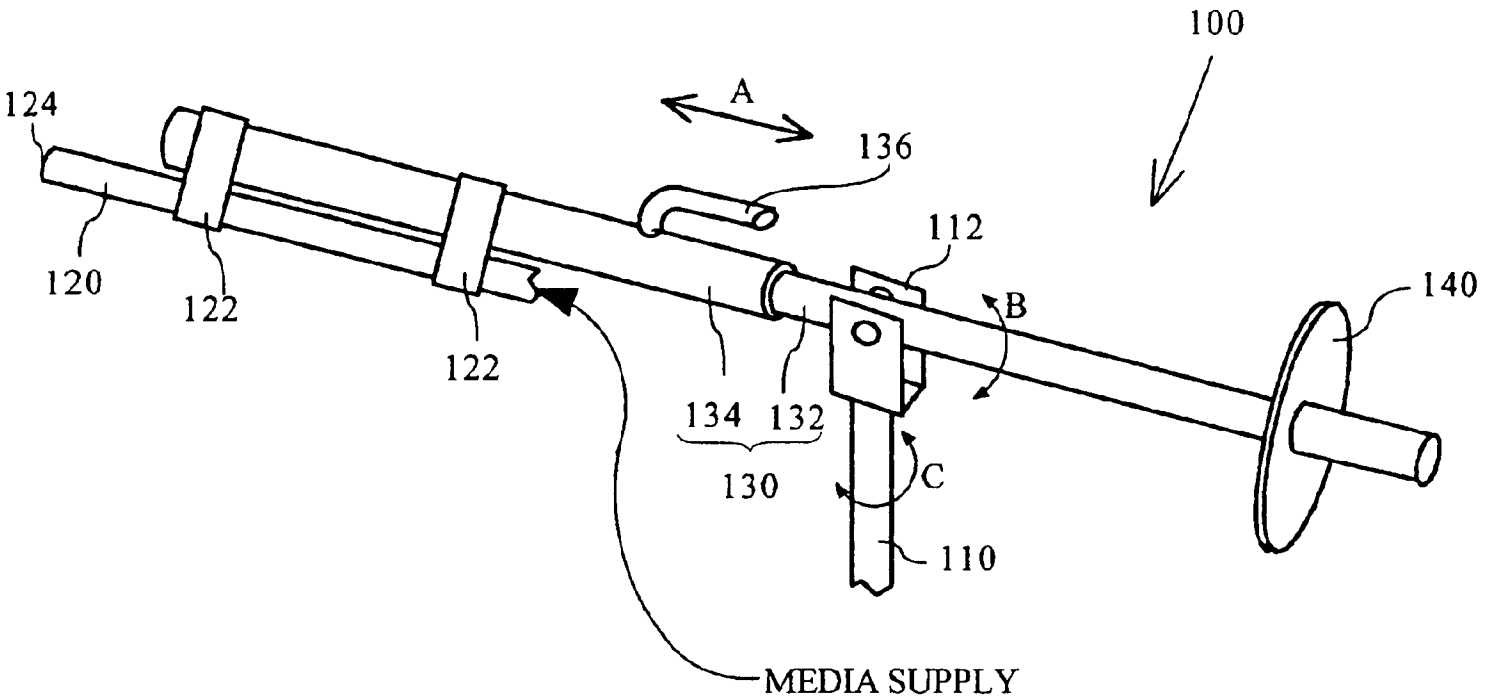
FIG. 1 is a perspective view of an exemplary media discharge device according to the invention.

FIG. 1 is a perspective view of an exemplary media discharge device 100 according to the invention. The media discharge device 100 may be used to discharge any type of wet or dry media. The media discharge device 100 includes a support member 110, a telescoping device 130 supported by the support member 110, and a media passage 120. The media passage 120 may be a flexible hose or tube, for example, and has an opening or port 124 through which media is discharged. The discharge opening 124 may be of the same diameter as the media passage 120, or may include a nozzle (not shown) of a diameter smaller than the diameter of the media passage 120. Such a nozzle may be detachable so that it can be replaced, or interchanged with nozzles of different sizes. The support member 110 may be affixed to a stationary object, such as the floor, a frame, or the like, or to a semi-stationary object, such as a cart or the like.

The media passage 120 is shown connected to the outside of the telescoping device 130 by mounting brackets 122, but alternatively may pass through the inside of the telescoping device 130.

The telescoping device 130 is supported via a joint structure 112 that allows the telescoping device 130 to rotate with respect to the support member 110 with at least one degree of freedom, and preferably two degrees of freedom. For example, the telescoping device 130 may rotate vertically, in the direction shown by arrow B, and/or horizontally, in the direction shown by arrow C. A two degrees of freedom structure will be advantageous in most situations, but a one degree of freedom structure may be appropriate for some situations in which, for example, only a linear band-shaped area requires media discharge. The joint structure 112 may, for example, be a universal joint or gimbal that allows the telescoping device 130 to be angled upward and downward and rotated clockwise and counter-clockwise.

The telescoping device 130 includes a first member 132 and a second member 134 that moves with respect to the first member 132 in the direction shown by arrow A, i.e., in an extending direction and a retracting direction. For example, as shown in FIG. 1, the first member 132 may be a tube-like member and the second member 134 may be a tube-like member of a slightly larger diameter such that it fits over and slides on the first member 132. Other telescoping structures and configurations are possible, and the first member 132 does not necessarily have to be concentric with the second member 134. The second member 134 may slide freely with respect to the first member 132, or may be driven by an actuator, as described below.

A handle 136 may be attached to the telescoping device 130, and an operator may grip the handle to manipulate the telescoping device. Alternatively, an operator may grip the telescoping device 130 directly. The handle 136 is shown attached to the second member 134, but may, under some circumstances, be provided on the first member 132. Specifically, for example, if an actuator is provided, as described below, the handle 136 may, if desired, be provided on the first member 132.

A counter weight 140 is provided at an end of the telescoping device 130 opposite to the end where the media discharge opening 124 is provided. The counter weight 140 balances the weight of the media discharge device 100 so that the operator does not need to support the weight. The counter weight 140 may be fixed in place on the telescoping device 130. Alternatively, the counter weight 140 may be movable along the telescoping device 130. For example, the counter weight 140 may be mechanically geared or electronically controlled so that when the second member 134 moves along the first member 132, the counter weight 140 moves along the first member in the opposite direction by a proportionate amount, thus maintaining the media discharge device 100 in a constantly balanced state.

As described above, the second member 134 may move freely with respect to the first member 132. However, this structure, while relieving the operator of the weight of the media discharge device 100, still requires the operator to bear much of the reactive force of the media discharge. Therefore, the second member 134 is preferably driven with respect to the first member 132 by an actuator. In this case, the actuator bears the reactive forces.

Figure 2:
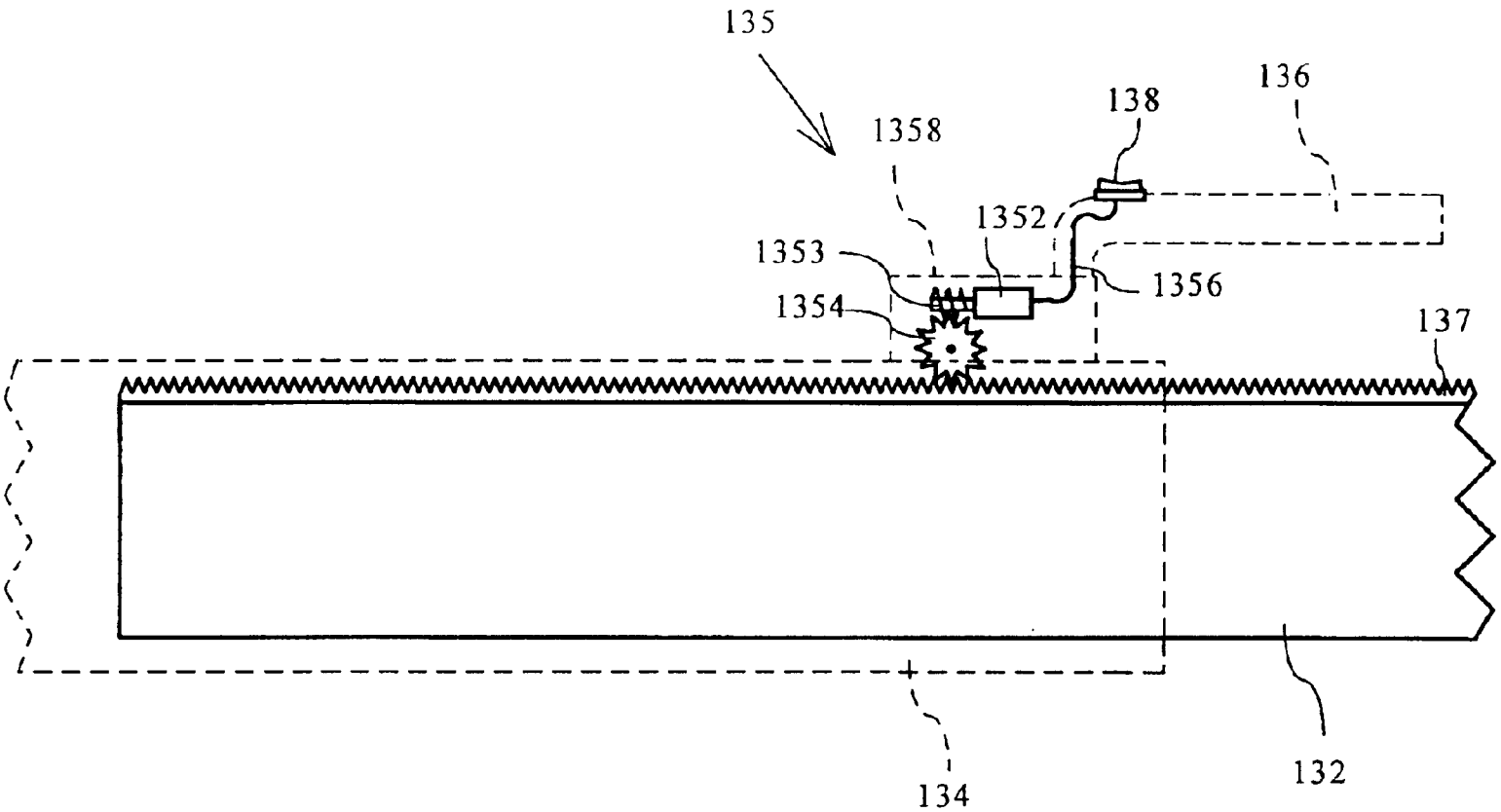
FIG. 2 shows a first exemplary embodiment of an actuator structure of the media discharge device of FIG. 1.

FIG. 2 shows a first exemplary embodiment of an actuator structure 135 of the media discharge device 100 of FIG. 1. In this embodiment, a linear gear 137 is provided along the first member 132, and is fixed with respect to the first member 132. A rotary gear 1354 rotates about an axis that is fixed with respect to the second member 134. The rotary gear 1354 engages with the linear gear 137; thus, when the rotary gear 1354 rotates, the second member 134 moves with respect to the first member 132.

The rotary gear 1354 is driven by a motor 1352, either directly or via another gear or gear train, such as a worm gear 1353 and/or the like. The motor 1352 is driven by a suitable power source (not shown). The motor 1352, the worm gear 1353 and the rotary gear 1354 may be accommodated within an actuator housing 1358. The handle 136 may be attached to the actuator housing 1358, and a switch 138 may be provided on the handle 136 or at any other suitable location.

The switch 138 may be, for example, a rocker switch and is coupled to the motor 1352 via a link 1356. When placed in a first switching position, the switch 138 causes the motor 1352 to turn in a first direction, and when placed in a second switching position, the switch 138 causes the motor 1352 to turn in a second direction. For example, when the switch 138 is a rocker switch and is rocked forward, i.e., when the left side of the switch is pressed down, the motor 1352 turns in a direction that causes the second member 134 to move leftward in FIG. 2. When the switch 138 is rocked backward, i.e., when the right side of the switch is pressed down, the motor 1352 turns in a direction that causes the second member 134 to move rightward in FIG. 2.

An example of structure that may substitute for the linear gear and worm gear structure shown in FIG. 2 is a ball screw structure (not shown), such as is commonly used on garage door openers, in which a long threaded member engages with a nut, and drives the nut, along with a member attached to the nut, along a longitudinal axis of the threaded member.

It should be appreciated that many switch types and configurations are possible. For example, to provide various speed options, such as slow forward, fast forward, slow reverse and fast reverse speeds, the switch 138 may have switching positions beyond merely a forward position and a reverse position. Additionally, rather than the single switch 138 shown in FIG. 2, a separate switch may be provided for each direction and/or speed.

Figure 3:
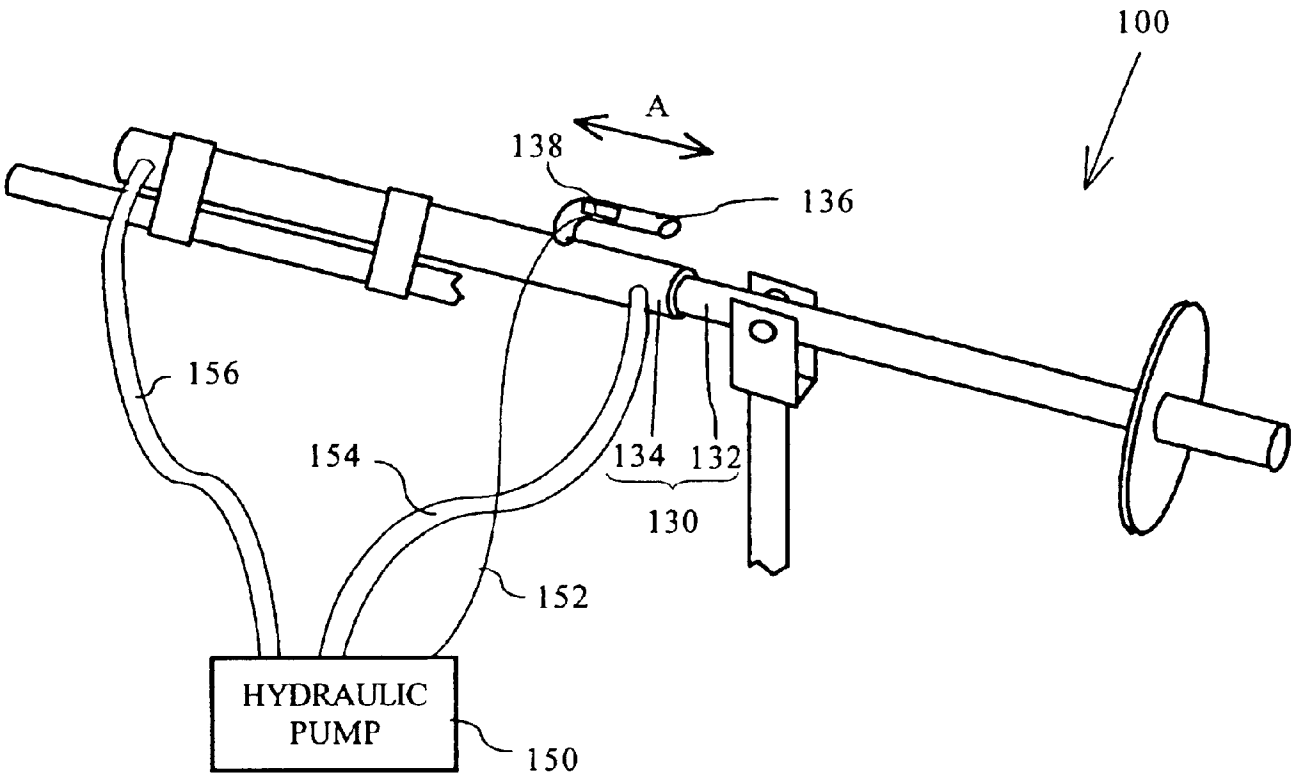
FIG. 3 shows a second exemplary embodiment of an actuator structure of the media discharge device of FIG. 1.

FIG. 3 shows a second exemplary embodiment of an actuator structure of the media discharge device 100 of FIG. 1. In this embodiment, the telescoping member 130 includes a hydraulic ram driven by a hydraulic pump 150 in a known manner. The hydraulic pump 150 forces fluid through passages 154 and 156 to drive the second member 134 back and forth along the first member 132.

The switch 138 in FIG. 3 directs the flow of hydraulic fluid in response to manipulation of the switch 138 by the operator. For example, the switch 138 may be an electrical switch that sends signals to a switching valve assembly (not shown) within the hydraulic pump 150, causing the pump to send fluid through the passage 154 or 156 as appropriate.

Figure 4:
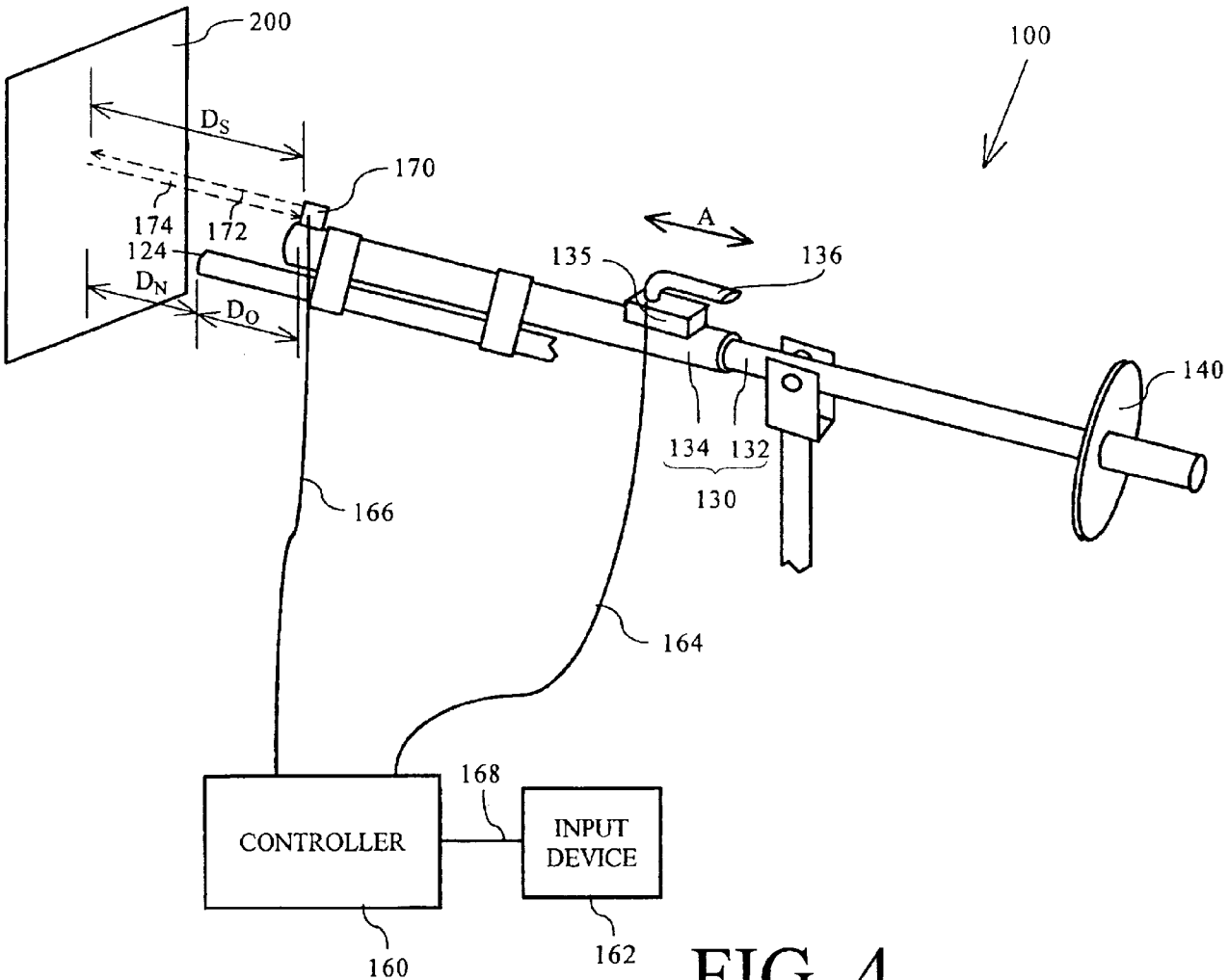
FIG. 4 shows a third exemplary embodiment of an actuator structure of the media discharge device of FIG. 1.

FIG. 4 shows a third exemplary embodiment of an actuator structure of the media discharge device 100 of FIG. 1. The media discharge device 100 of this embodiment is self-adjusting by virtue of a controller 160 and a standoff sensor 170.

The controller 160 is coupled via a link 164 to an actuator structure 135, which may, for example, be the same as actuator 135 shown in FIG. 2. The controller 160 is also coupled to the sensor 170 via a link 166, and may also be connected to an input device 162 via a link 168.

The standoff sensor 170 is attached to the telescoping device 130, and senses a distance $D_S$ from the sensor 170 to a surface to which media is discharged. For example, the standoff sensor 170 may be of a type that sends out an optical (e.g, laser or infrared) or acoustic wave 172, detects a return wave 174 reflected by the surface 170, and calculates the distance $D_S$ based on the time lapse between sending the wave 172 and detecting the return wave 174. The standoff sensor 170 transmits the distance $D_S$ to the controller 160 (or transmits raw data to the controller 160, and the controller 160 calculates the distance $D_S$).

It should be appreciated that the distance $D_S$ between the sensor 170 and the surface 200 may not be the same as the distance $D_N$ between the discharge opening 124 and the surface. In this case, if the distance $D_O$ between the opening 124 and the sensor 170 along the longitudinal axis of the telescoping device 130 is known, the distance $D_N$ may be obtained by subtracting $D_O$ from $D_S$ (if the opening 124 is closer than the sensor 170 to the surface 200) or adding $D_O$ to $D_S$ (if the opening 124 is farther than the sensor 170 from the surface 200). The operator may set a desired value for the distance $D_N$ via the input device 162. A display (not shown) may be linked to the controller 160 to display the current value and/or the value newly input by the operator to allow the operator to confirm that the intended value has been set.

The controller 160 determines whether the value $D_N$ is equal to the currently set desired value (target value), and sends a signal to the actuator 135 as needed to adjust the value $D_N$. This process is repeated constantly as the telescoping device 130 is moved by the operator, thus maintaining the opening 124 at a constant distance from the surface 200.

Figure 5:
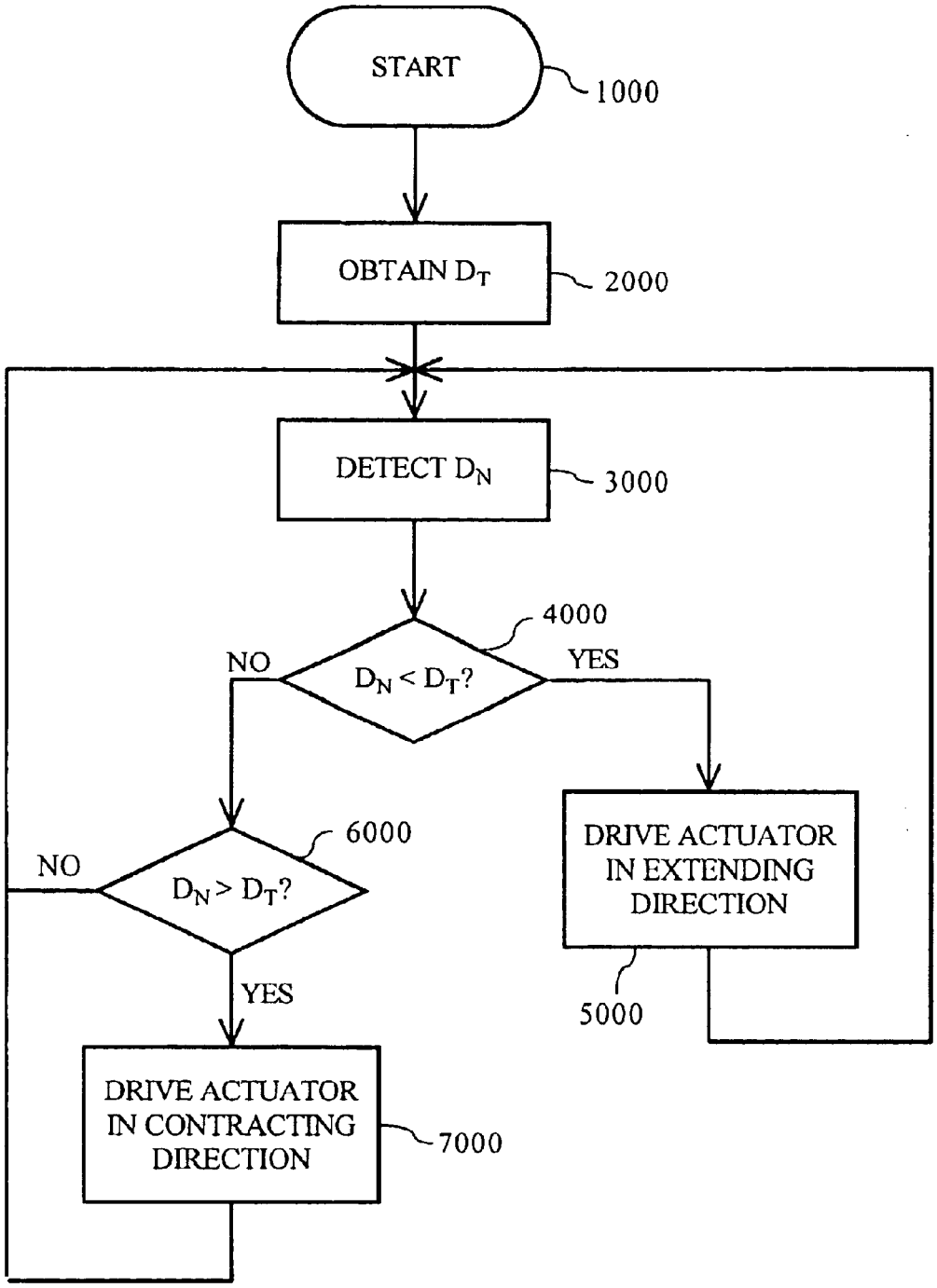
FIG. 5 is a flowchart of an exemplary process performed by the controller of FIG. 4.

FIG. 5 is a flowchart of an exemplary process performed by the controller 160 of FIG. 4. Beginning in step 1000, the process proceeds to step 2000 and obtains a target value $D_T$ between the opening 124 and the surface 200 (see FIG. 4). As described above, this target value may be input by the operator. The process then continues to step 3000.

In step 3000, the actual distance $D_N$ between the opening 124 and the surface 200 is detected. As described above, if necessary, $D_N$ may be calculated by adding or subtracting a distance $D_O$ to/from a distance $D_s$ between the sensor 170 and the surface 200. The process then proceeds to step 4000 and determines whether $D_N$ is less than $D_T$. If $D_N$ is less than $D_T$, the process continues to step 5000. Otherwise, the process jumps to step 6000.

In step 5000, the actuator 135 is driven so as to cause the telescoping device 130 to extend. The process then returns to step 3000 and repeats steps 3000–4000.

In step 6000, it is determined whether $D_N$ is less than $D_T$. If $D_N$ is greater than $D_T$, the process continues to step 7000. Otherwise, the process returns to step 3000. In step 7000, the actuator 135 is driven so as to cause the telescoping device 130 to contract. The process then returns to step 3000 and repeats steps 3000–4000.

Figure 6:
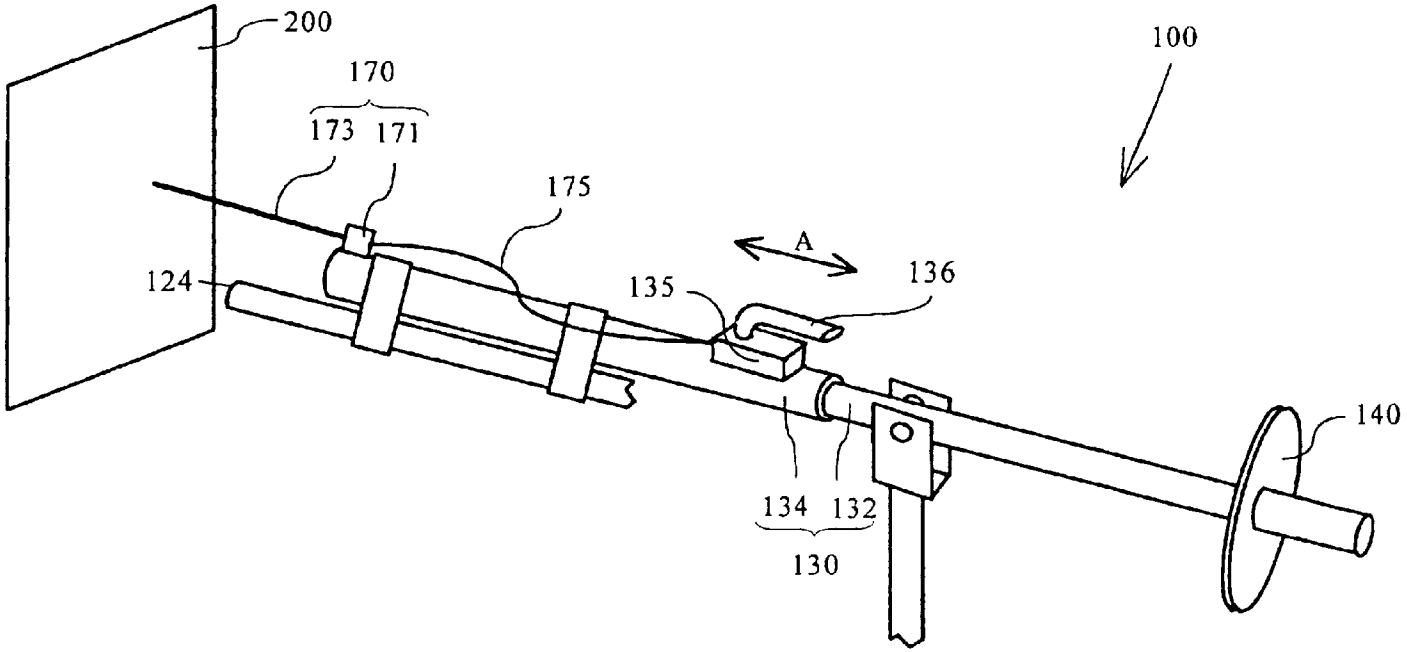
FIG. 6 shows a fourth exemplary embodiment of an actuator structure of the media discharge device of FIG. 1.

Another example of the standoff sensor 170 is shown in FIG. 6, which shows a fourth exemplary embodiment. In this embodiment, the standoff sensor 170 is a mechanical type of sensor, such as a sensor known as a whisker switch. The standoff sensor 170 includes a mechanical feeler 173, which may be a thin wire, rod or the like, connected to a switch 171. When the feeler 173 contacts the surface 200 to which the media is discharged, the switch 171 transmits a signal to the actuator 135 via a link 175, that causes the telescoping device 130 to retract. When the feeler 173 is pulled away from the surface 200, the switch 171 sends a signal to the actuator 135 that causes the telescoping device 130 to extend. Thus, the desired distance between the opening 124 and the surface 200 can be maintained.

In FIGS. 2–4 and 6, the handle 136 is attached to the actuator 135, which is attached to the second member 134. However, an operator may desire to manipulate the media discharge device 100 by holding the first member 132, rather than the second member 134, for the following reason, for example. When the operator holds the second member 134 and manipulates the media discharge device, this operator must allow his or her hand to follow the extending and retracting movement of the telescoping device 130, while at the same time exerting lateral forces on the telescoping device 130 to pivot the telescoping device 130 relative to the support member 110. While focusing on the pivoting movement of the telescoping device 130, the operator may tend to naturally resist movement in the extending and retracting directions, because such movement is "unexpected" in the sense that the operator is not directly applying or controlling forces in these directions. This is particularly true in the embodiments of FIGS. 4 and 6, in which the instructions to the actuator 135 to extend or retract the telescoping device 130 come via the standoff sensor 170, rather than directly from the operator. Such resistance, though slight, may result in increased fatigue over time. In contrast, if the operator holds the first member 132 by, e.g., gripping the end near the counter weight 140, the operator's hand will not be subject to this "unexpected" component of movement. Thus, in embodiments, the handle 136 (and switch 138 in the embodiment of FIGS. 2–3) may be provided on the first member 132, or the handle 136 may be omitted and the operator may directly grip the first member 132 when manipulating the media discharge device 100.

Figure 7:
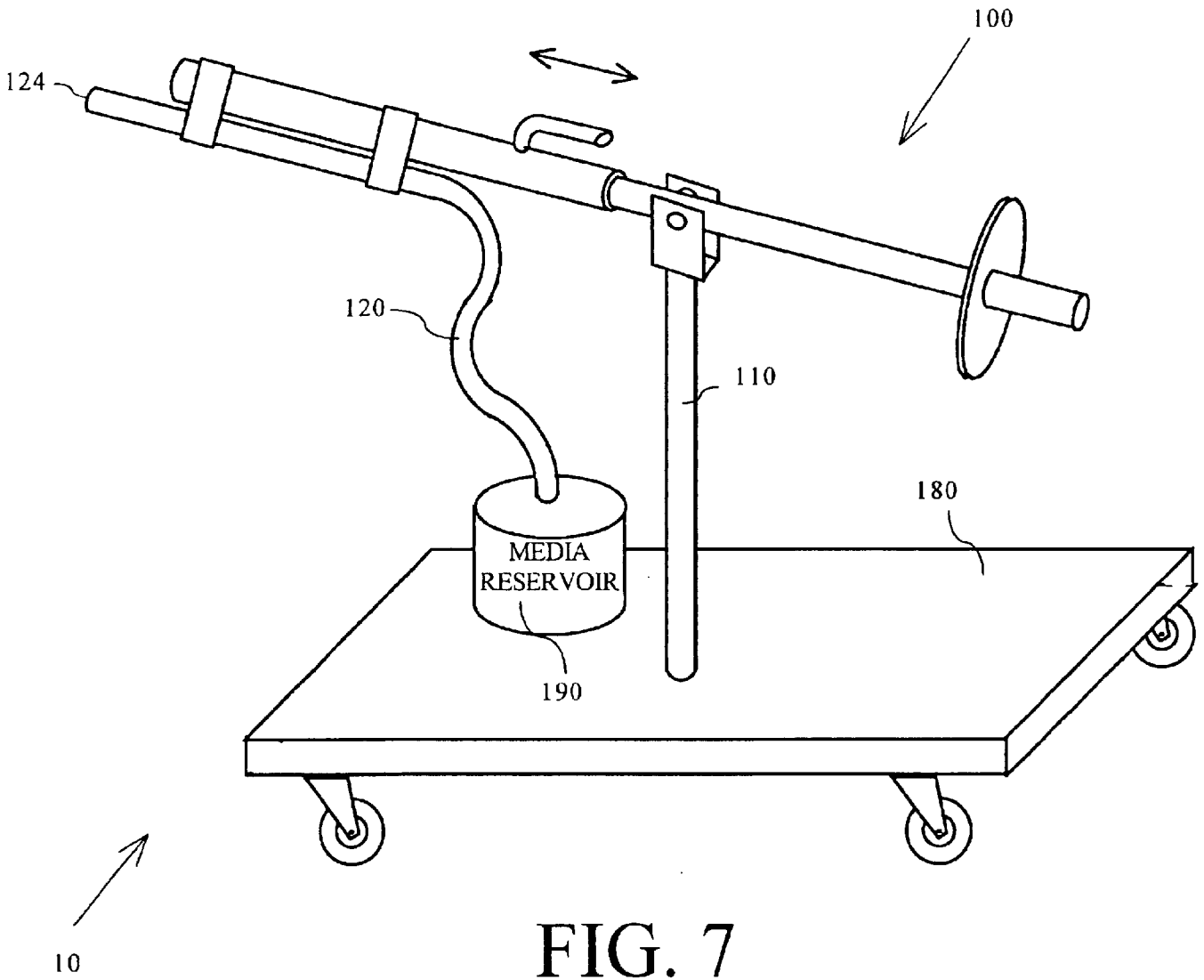
FIG. 7 is a perspective view of an exemplary media discharge system incorporating the media discharge device of FIG. 1.

FIG. 7 is a perspective view of an exemplary media discharge system 10 incorporating the media discharge device 100 of any of FIGS. 1–4 or 6. The media discharge system 10 includes a semi-stationary object 180, such as a cart or the like, to which the support member 110 of media discharge device 100 is affixed. A media reservoir 190 is also provided, and media is supplied from the media reservoir 190 through the media passage 120 and discharged from the media discharge opening 124 by, for example, air pressure from a suitable air pressure source such as an air compressor (not shown).

Media discharge devices and systems embodying this invention may be used, for example, for dry media discharge, such as sandblasting, or for wet media discharge, such as spray painting or spraying water, cleaning solution or the like. The weight of the discharge device 100 and/or the reactive forces from the media discharge are transferred to a stationary object, such as the floor, or a non-stationary object, such as the cart 180 of FIG. 6, via the joint structure 112 and the support member 110. Therefore, operator fatigue is reduced.

While the systems and methods according to this invention have been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

For example, in addition to the switch 138 shown in FIGS. 2 and 3, switches may also be provided for controlling media flow or other process parameters. For example, a switch may be provided to start and stop the flow of media through the media discharge opening 124, to control the flow rate of media, and/or the like. The user input device 162 of FIG. 4, while shown as a separate device, may be incorporated directly into the actuator 135.

What is claimed is:

1. A media discharge device, comprising:

a support member;

a telescoping device supported by the support member via a joint structure that allows the telescoping device to rotate with respect to the support member with at least one degree of freedom, the telescoping device comprising a first member and a second member that moves with respect to the first member in an extending direction and a retracting direction during operation of the media discharge device;

a media discharge port provided on the telescoping device; and a counterweight provided on the telescoping devices;

wherein the joint structure is one of a gimbal joint and a universal joint.

2. The media discharge device of claim 1, further comprising an actuator that drives the second member in the extending direction and in the retracting direction.

3. The media discharge device of claim 2, wherein the actuator is selected from the group consisting of a hydraulic actuator, a gear-driven actuator and a threaded actuator.

4. A media discharge device, comprising:

a support member;

a telescoping device supported by the support member via a joint structure that allows the telescoping device to rotate with respect to the support member with at least one degree of freedom, the telescoping device comprising a first member and a second member that moves with respect to the first member in an extending direction and a retracting direction during operation of the media discharge device;

a media discharge port provided on the telescoping device;

an actuator that drives the second member in the extending direction and in the retracting direction; and a standoff sensor that is associated with the actuator and maintains a predetermined distance between the media discharge port and an object to which media is discharged.

5. The media discharge device of claim 4, wherein the standoff sensor comprises:

a sensor that detects a distance to the object; and a controller that controls the actuator to drive the second member based on the detected distance and thereby maintain the predetermined distance between the media discharge port and the object.

6. The media discharge device of claim 5, further comprising an input device connected to the controller, the input device inputting a desired value corresponding to the predetermined distance.

7. The media discharge device of claim 6, wherein the input device is a user input device.

8. The media discharge device of claim 4, wherein the standoff sensor comprises:

a mechanical feeler that contacts the object; and a switch, operatively connected to the mechanical feeler, that controls the actuator to drive the second member based on whether the mechanical feeler is in contact with the object and thereby maintain the predetermined distance between the media discharge port and the object.

9. The media discharge device of claim 2, wherein the actuator includes a manual switch.

10. The media discharge device of claim 1, wherein the joint structure is freely manually manipulatable.

11. The media discharge device of claim 1, wherein the second member has one degree of freedom with respect to the first member.

12. A media discharge system, comprising:

the media discharge device of claim 1; and a media reservoir connected to the discharge port by a media passage.

13. A media discharge system, comprising:

the media discharge device of claim 1; and a semi-stationary object that holds the media discharge device.

14. A media discharge device, comprising:

a support member;

a telescoping device supported by the support member via a joint structure that allows the telescoping device to rotate with respect to the support member with at least one degree of freedom, the telescoping device being supported at only a single point, the telescoping device comprising a first member and a second member that moves with respect to the first member in an extending direction and a retracting direction during operation of the media discharge device;

a counterweight provided on the telescoping device; and a media discharge port provided on the telescoping device.

15. The media discharge device of claim 14, wherein the joint structure is one of a gimbal joint and a universal joint.

16. A media discharge device comprising:

a support member;

a telescoping device having a first end and a second end, the telescoping device being supported by the support member via a joint structure that allows the telescoping device to rotate with respect to the support member with at least one degree of freedom, the telescoping device being supported at only a single point and allowed to move in an extending direction and a retracting direction during operation of the media discharge device;

a media discharge port provided at the first end of the telescoping device; and a counter weight provided near the second end of the telescoping device and suspended in mid-air during operation of the media discharge device.

17. A media discharge device, comprising:

a support member;

a telescoping device supported by the support member via a joint structure that allows the telescoping device to rotate with respect to the support member with at least one degree of freedom, the telescoping device comprising a first member and a second member that moves with respect to the first member in an extending direction and a retracting direction during operation of the media discharge device; and a media discharge port provided on the telescoping device;

wherein the joint structure is one of a gimbal joint and a universal joint and the joint structure is freely manually manipulatable.

18. The media discharge device of claim 17, further comprising an actuator that drives the second member in the extending direction and in the retracting direction.

19. The media discharge device of claim 18, wherein the actuator is selected from the group consisting of a hydraulic actuator, a gear-driven actuator and a threaded actuator.

20. A media discharge device, comprising:

a support member;

a telescoping device supported by the support member via a joint structure that allows the telescoping device to rotate with respect to the support member with at least one degree of freedom, the telescoping device being supported at only a single point, the telescoping device comprising a first member and a second member that moves with respect to the first member in an extending direction and a retracting direction during operation of the media discharge device; and a media discharge port provided on the telescoping device;

wherein the joint structure is freely manually manipulatable.

21. The media discharge device of claim 20, wherein the joint structure is one of a gimbal joint and a universal joint.

* * * * *